US005083914A

United States Patent [19]

Morris et al.

[11] Patent Number: 5,083,914

[45] Date of Patent: Jan. 28, 1992

[54] ADJUSTABLE PRESSURE JET BURNER

[76] Inventors: William H. D. Morris, 18 Muldowney Ct., Malahide, County Dublin; Michael P. Walshe, 98 Idrone Park, Knocklyn, Templeogue, Dublin 6 both of Ireland

[21] Appl. No.: 547,520

[22] Filed: Jul. 2, 1990

[30] Foreign Application Priority Data

Aug. 22, 1989 [IE] Ireland ..... 2699/1989

[51] Int. Cl.[5] ..... F23C 5/06

[52] U.S. Cl. ..... 431/189; 431/265; 126/5; 239/587

[58] Field of Search ..... 431/186, 189, 265; 239/587; 126/5

[56] References Cited

U.S. PATENT DOCUMENTS

| | | | |
|---|---|---|---|
| 1,781,796 | 11/1930 | Willcox et al. | 431/189 |
| 2,747,655 | 5/1956 | Farnham | 431/186 |
| 2,986,336 | 5/1961 | Sharkey | 239/587 |
| 3,361,362 | 1/1968 | Edwards | 239/587 |
| 4,047,879 | 9/1977 | Mitchell et al. | 431/265 |

FOREIGN PATENT DOCUMENTS

| | | |
|---|---|---|
| 496571 | 4/1930 | Fed. Rep. of Germany . |
| 581563 | 7/1933 | Fed. Rep. of Germany . |
| 0418395 | 10/1934 | United Kingdom . |
| 068792 | 1/1953 | United Kingdom . |
| 1069668 | 7/1965 | United Kingdom . |
| 1325563 | 8/1973 | United Kingdom . |
| 1552553 | 10/1975 | United Kingdom . |
| 2078928A | 12/1979 | United Kingdom . |
| 2219389A | 12/1989 | United Kingdom . |

*Primary Examiner*—Carroll B. Dority
*Attorney, Agent, or Firm*—Ladas & Parry

[57] ABSTRACT

The invention provides a pressure jet burner comprising a blast tube mounted on a housing. The directional position of the blast tube may be adjusted from a horizontal position to a vertical position or any intermediate position. A fan is located in a housing for supplying air to the blast tube via a horizontal duct.

4 Claims, 7 Drawing Sheets

ADJUSTABLE PRESSURE JET BURNER

The present invention relates to improvements in pressure jet burners of the type which use oil or gas as fuel.

According to a first aspect of the invention there is provided a pressure jet burner comprising a blast tube mounted on a housing, and adjustment means whereby the directional position of the blast tube is adjustable both whilst the burner is operating and whilst it is not operating, the blast tube comprising a tubular body for conveying air within which is a nozzle for fluid fuel, the blast tube carrying a ceramic plate surrounding it and projecting outwardly from it.

According to a second aspect of the invention, there is provided a pressure jet burner comprising a blast tube mounted on and above and communicating with a generally horizontal duct which is in turn mounted on and above a housing containing air-supply means which supply air to the blast tube via said duct, the burner further comprising adjustment means whereby the directional position of the blast tube is adjustable both whilst the burner is operating and whilst it is not operating, the blast tube comprising a tubular body for conveying air within which is a nozzle for fluid fuel, said tubular body being fixed to the nozzle, the nozzle having an actuating rod which is operatively associated with an operating arm such that movement of the operating arm adjusts the position of the blast tube.

According to a third aspect of the invention, there is provided a combined cooker/boiler comprising a combustion chamber, a water jacket which bounds the combustion chamber and from which hot water may be supplied, a hot gas outlet from the combustion chamber, from which hot gas may be supplied for use in cooking, a pressure jet burner within the combustion chamber and comprising a blast tube having an inlet and an outlet, a nozzle for fluid fuel within the blast tube and supported by it, means for supplying air to the inlet of the blast tube, means for supplying a fluid fuel to the nozzle, a bearing supporting the blast tube so that it can turn about an axis which is transverse with respect to the blast tube and actuating means for turning the blast tube from a first position, in which the blast tube is wholly within the combustion chamber and the nozzle is directed outwards the water jacket, to a second position, in which the blast tube is wholly within the combustion chamber and the nozzle is directed towards the hot gas outlet of the combustion chamber.

Embodiments of the invention will now be described by way of example with reference to the accompanying drawings in which.

Figure 1:
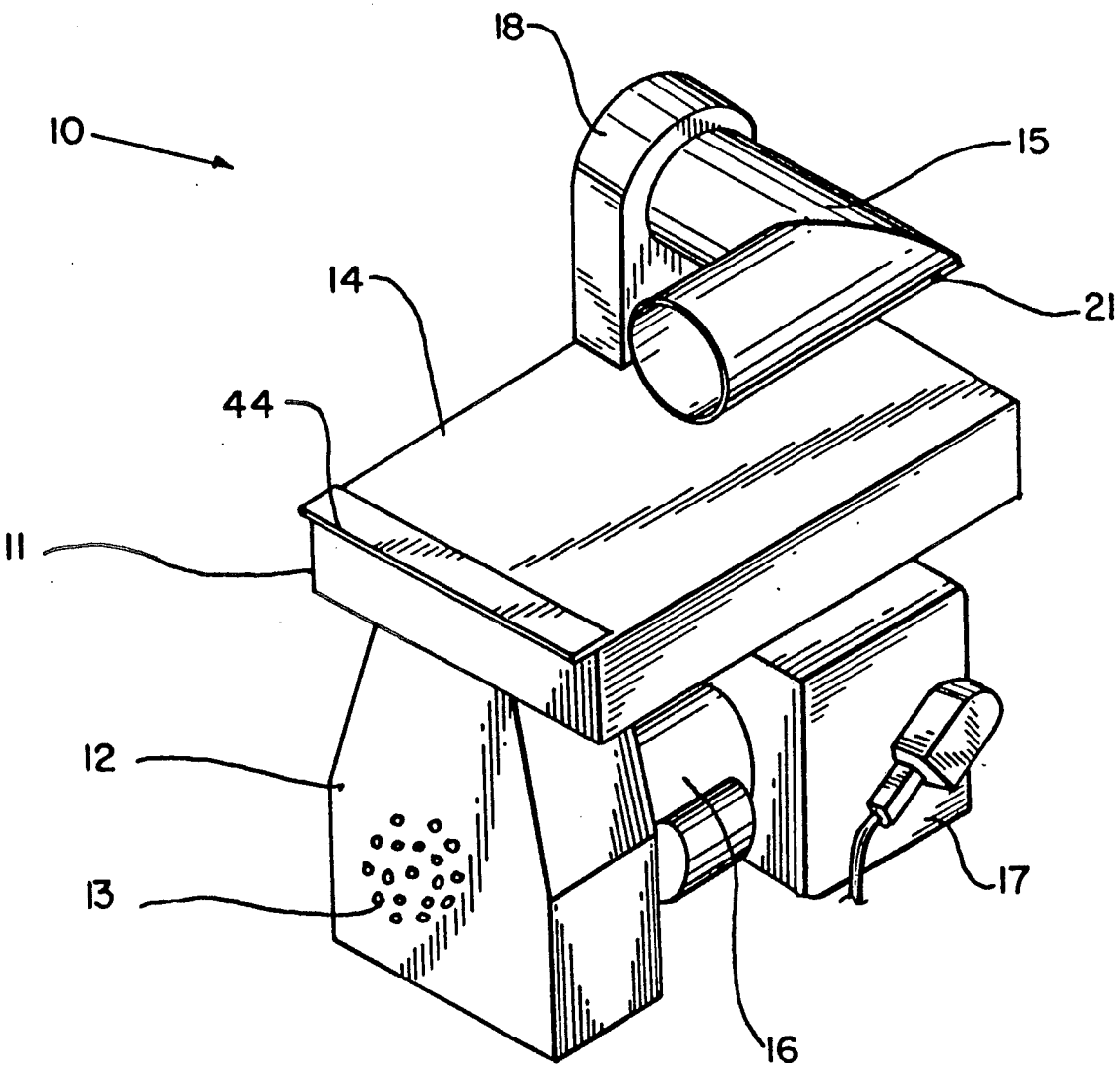
FIG. 1 is a perspective view of a pressure jet burner according to the invention.
Figure 2:
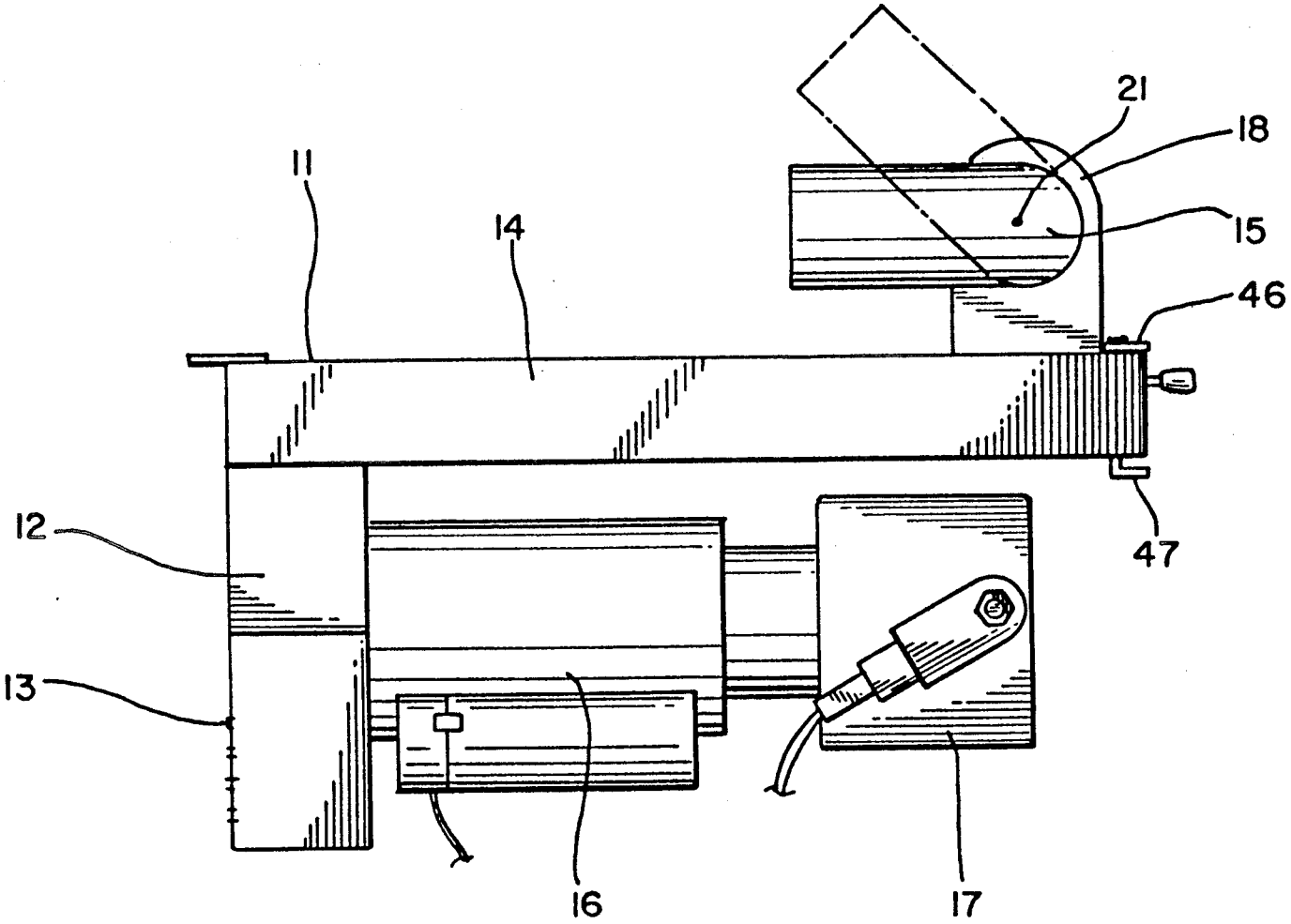
FIG. 2 is a side view of the burner of FIG. 1.

Referring now to the drawings wherein similar numerals have been used to indicate like parts there is shown therein a pressure jet burner generally indicated at 10 according to the invention. The burner 10 is generally similar to that described in the Applicant's co-pending British Patent Application No. 8908473.5 filed on Apr. 14, 1989 and entitled "Improved Pressure Jet Burner", the contents of which are incorporated herein by reference.

The burner 10 comprises a housing 11 including a fan housing 12 in which is located a fan (not shown) which draws air into the housing 11 via apertures 13. The fan housing 12 communicates with a generally horizontal duct 14 for supplying air to a blast tube 15. An electric motor 16 is mounted on the fan housing 12 and drives the fan and also operates a fuel pump 17 as is known in the art. The fuel pump 17 supplies fuel to the blast tube via a supply pipe (not shown) in conventional manner. Thus, air which is drawn into the fan housing 12 is forced through the horizontal duct 14 to the blast tube 15. As shown, the blast tube 15 is mounted on an upstanding hollow support 18 which communicates with the duct 14.

The blast tube 15 is L-shaped, i.e. generally cylindrical and is formed in the shape of a right angle. The blast tube is movable from a position in which both links of the L extend generally horizontally and the limb further from the support 18 is parallel to the duct 14 (FIG. 1) to a position in which the limb nearer the support 18 is horizontal and the other limb extends generally vertically upwards (FIG. 6) relative to the duct 14. The heat tube maybe also positioned in a number of intermediate positions.

Figure 3:
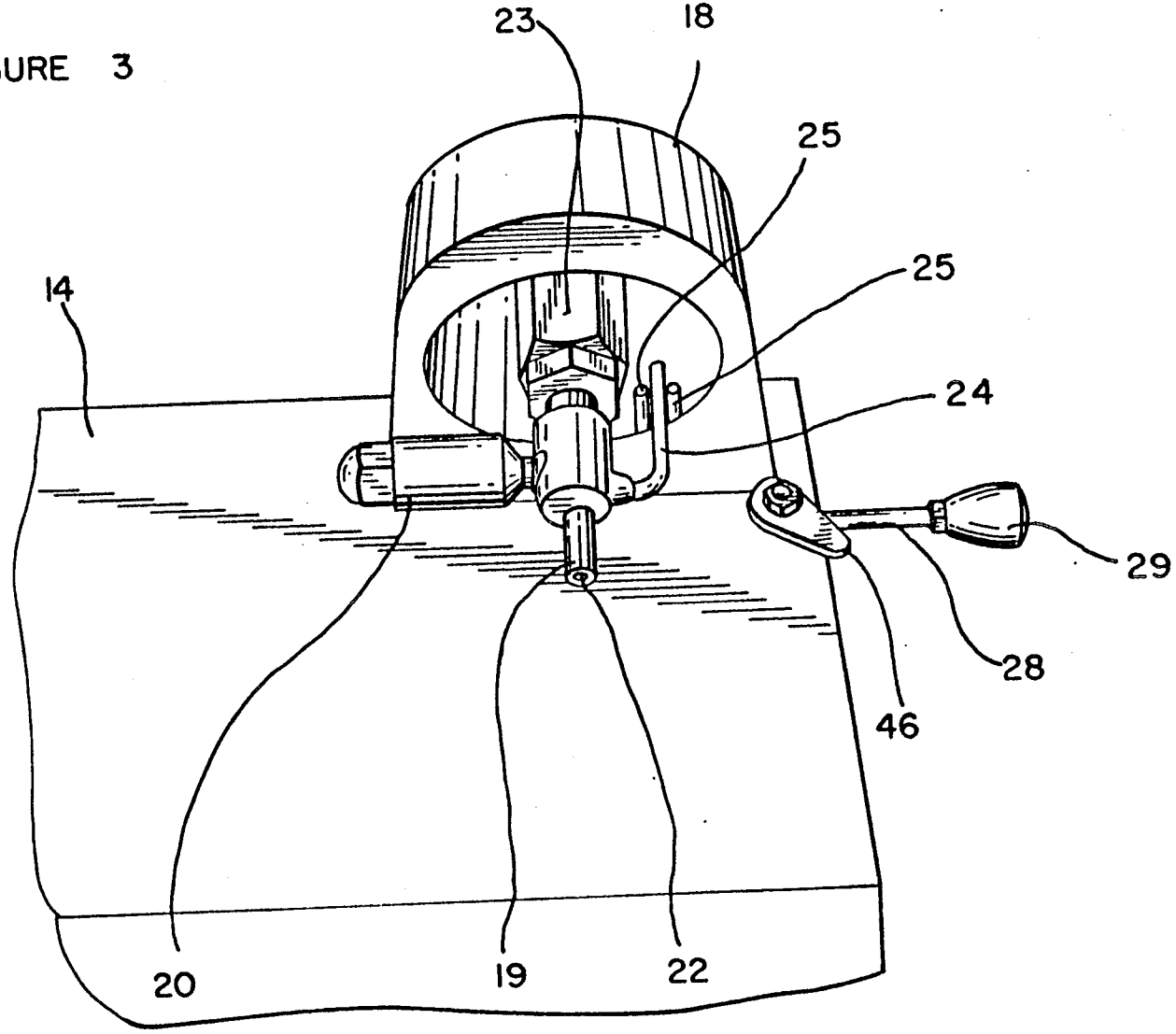
FIG. 3 is a perspective view of the fittings inside the blast tube with the blast tube removed.

In FIG. 3 the blast tube has been removed to reveal the fuel dispensing nozzle 20. The blast tube 15 is normally fixed by means of a screw 21 which engages in an aperture 22 in a lug 19 which extends laterally outwards from the nozzle 20. The fuel pipe from the fuel pump 17 is connected to a boss 23 which supplies fuel to the nozzle 20. The boss 23 is fixed to the support 18 and the nozzle 20 can rotate relative to the boss 23.

An actuating rod 24 which is fixed to the nozzle 20 extends into the hollow support 18. The actuating rod 24 is held between the upper ends 25 of a 'U' shaped control member 26, the lower end 27 of the control member 26 being fixed to an operating arm 28 which extends through the duct 14. The operating arm 28 has a handle 29 by which a user may move the operating arm 28 to adjust the directional position of the blast tube 15. Thus, as the operating arm 28 is moved backwards and forwards the 'U' shaped control member 26 causes the nozzle 20 and the blast tube 15 to rotate between a horizontal and a vertical position. Thus the angular position of the blast tube may be adjusted.

Figure 5:
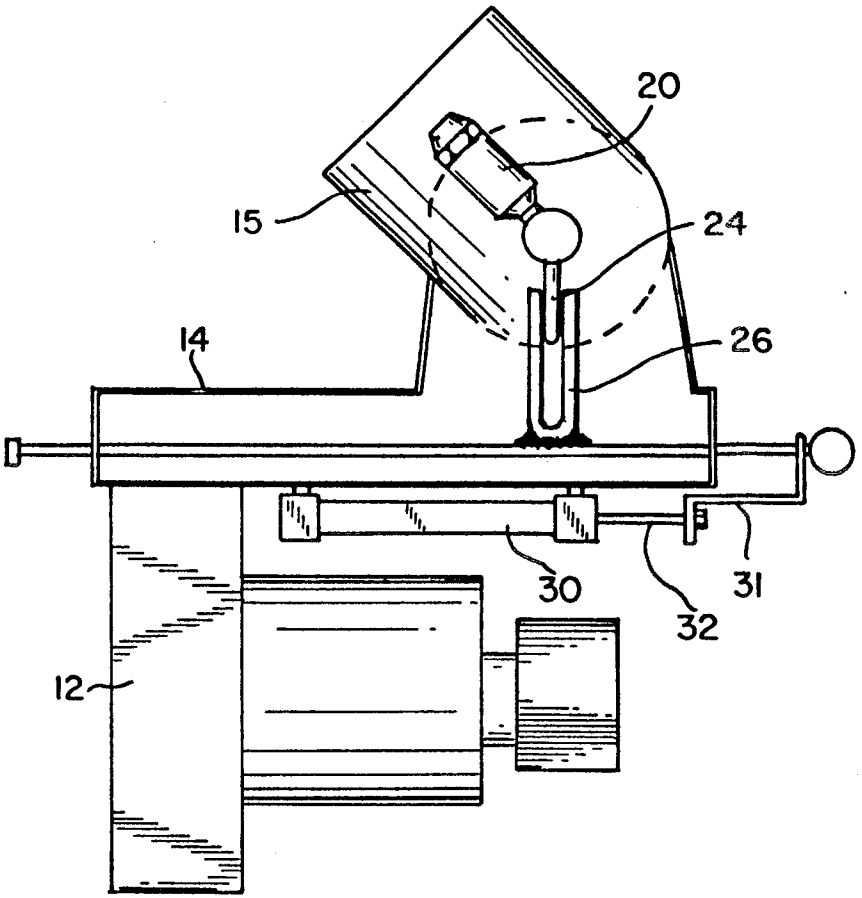
FIGS. 4, 5 and 6 are diagrammatic side views of the burner of FIG. 1 but incorporating an automatic adjusting means for the blast tube.
Figure 4:
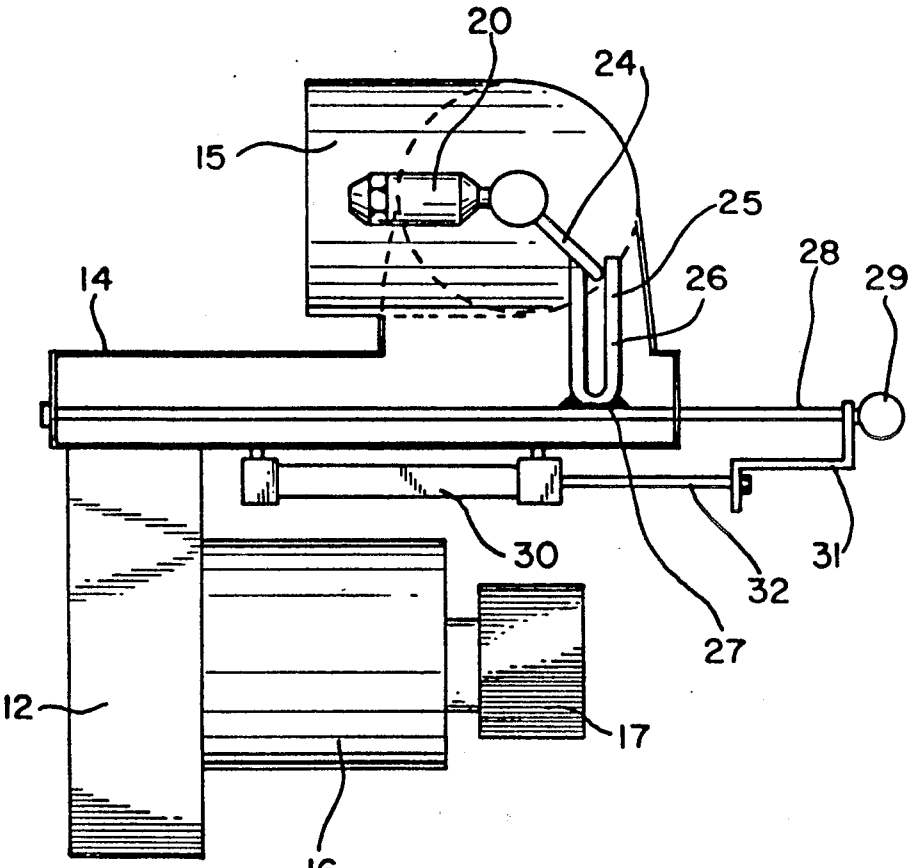
Figure 6:
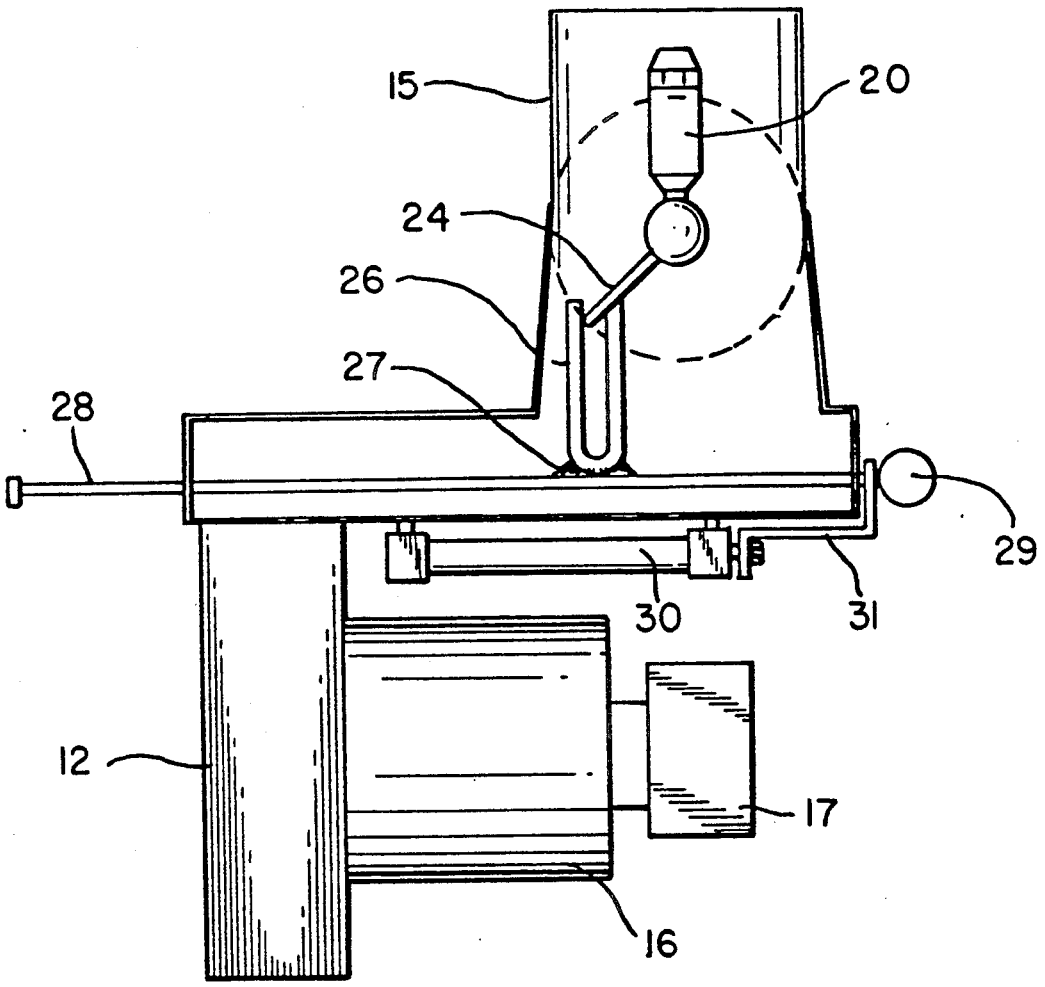

As shown more clearly in FIGS. 4, 5 and 6 the directional position of the blast tube 15 maybe adjusted automatically by means of a hydraulic ram 30 which is mounted on the underside of the duct 14. Thus, as shown a bracket 31 is connected between the operating arm 28 and the actuating arm 32 of the hydraulic ram 30. A suitable control system (not shown) is provided to energise the hydraulic ram 30 and move the blast tube to a position in which it heats either the oven or the boiler of a typical cooker/boiler (not shown). The control system for the hydraulic ram may be controlled by a thermostat connected to either the boiler, the oven or both. It will be appreciated that various types of control apparatus may be used for adjusting the position of the blast tube 15, for example, a pneumatic ram or an electric motor etc.

Both when the operating arm 28 is displaced by a user holding the handle 29 and when the arm 28 is displaced by the ram 30, to adjust the angular or directional position, i.e. the orientation, of the blast tube, this can be effected both when the burner is operating and when it is not operating.

Figure 7:
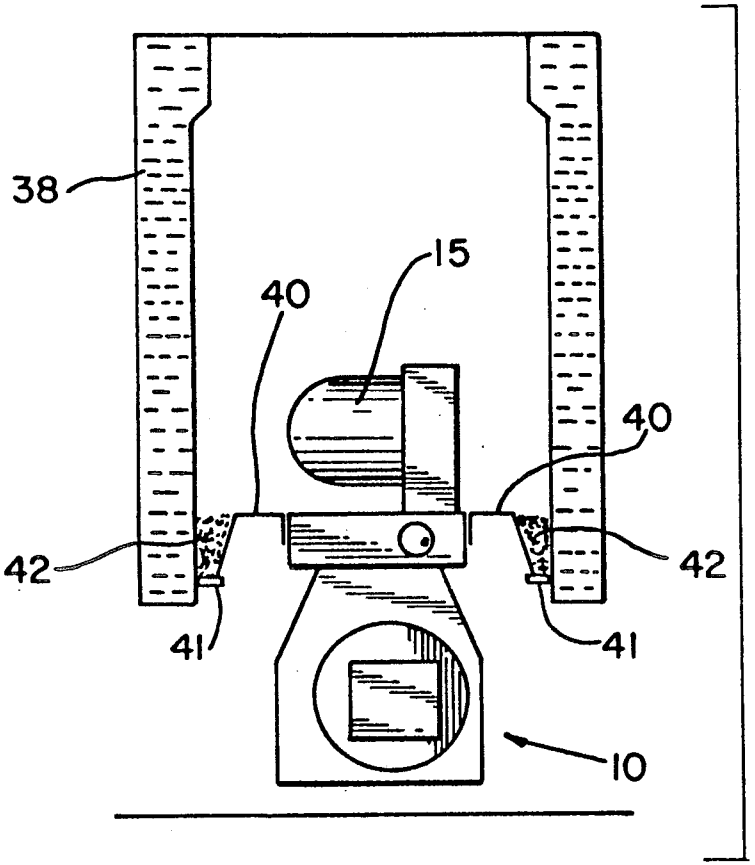
FIG. 7 is a front view of the burner of FIG. 1 installed in a conventional cooker/boiler.
Figure 9:
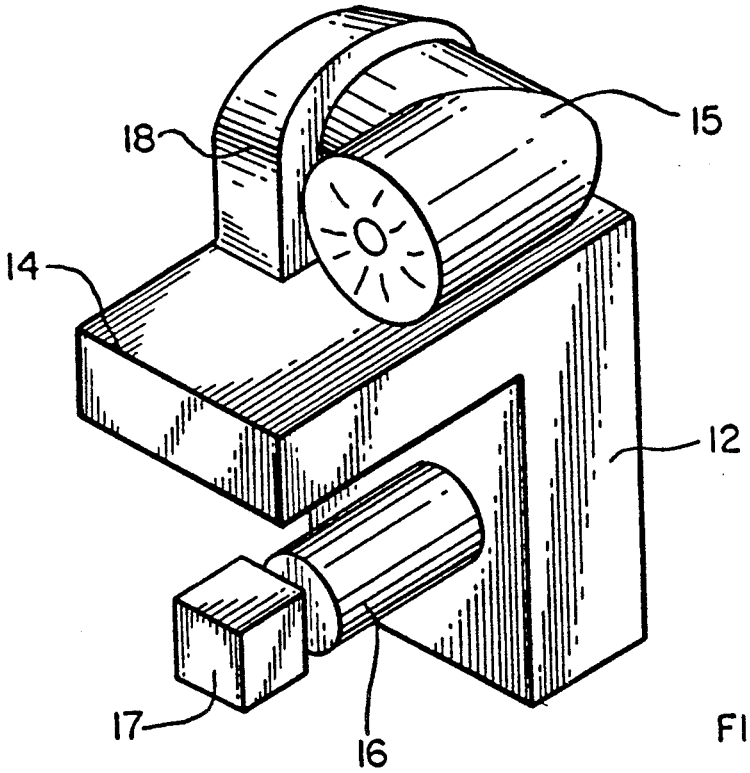

In use, the burner 10 is installed in a conventional cooker/boiler as shown in FIG. 7 having a water jacket 38. The burner 10 is installed by removing the firegrate and resting a mounting plate 40 on the normal grate supports 41. The plate 40 is made secure and air tight by packing ceramic fibre 42 around the edges of the plate 40 as shown. Further, at one end 43 of the duct 14, the burner has a projecting lip 44 which engages on the mounting plate 40 and at the opposite end 45 the duct 14 has a rotatable lug 46 which also engages on the opposite end of the mounting plate to secure the burner in place. The rotatable lug 46 is operated by a lever 47 on the underside of the duct 14. The flat and horizontal upper surface of the horizontal duct 14 forms part of the floor of the combustion chamber. The air is pre-heated as it flows through the duct 14 from the fan to the blast tube 15 and the duct 14 acts as a thermal barrier between the high temperature in the combustion chamber and components which might be damaged by excessive heat, e.g. the motor 16 and the fuel pump 17.

Figure 8:
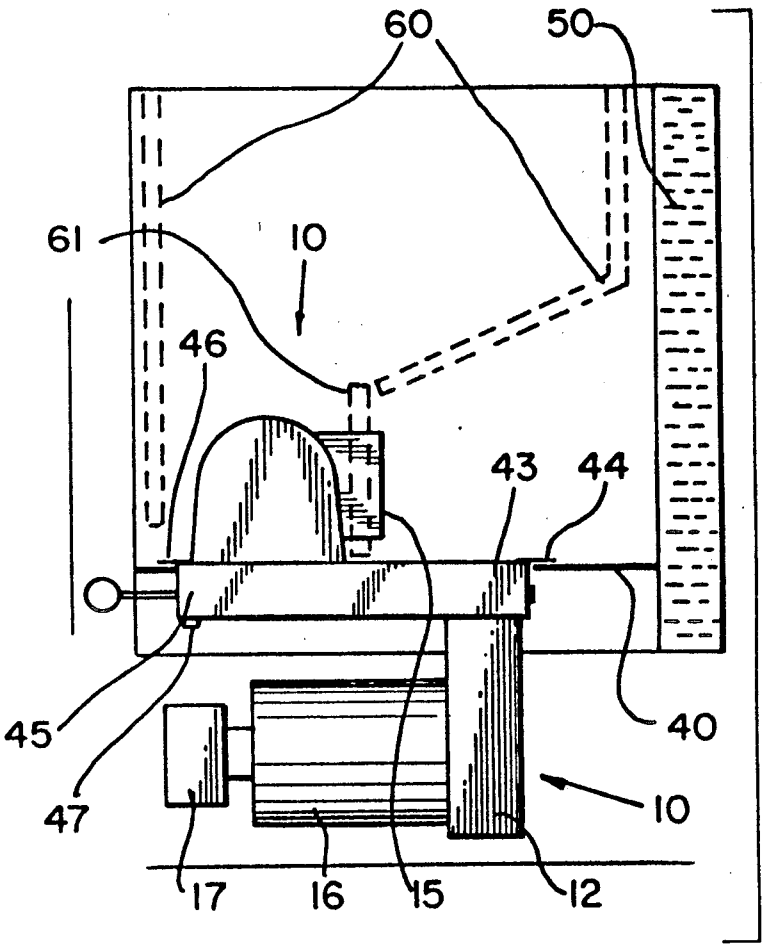
FIG. 8 is a side view of the burner of FIG. 1 installed in a conventional cooker/boiler.

Thus, as shown in FIG. 8, the blast tube 15 will provide maximum heating to the water jacket 50 and when moved to its vertical position it will provide maximum heat to the oven and hot plate of the cooker/boiler.

By fitting a ceramic heat shield as indicated in dotted outline at 60 in FIG. 8, the direction of heat to either the boiler or oven can be further controlled.

Further, a ceramic plate 61 may be fitted around the blast tube 15 so as to project radially outwardly from it as shown in dotted outline in FIG. 8. When the blast tube 15 is moved to the vertical position the plate 61 will co-operate with heat shields 60 to control the heat to the vertical direction.

It will be further appreciated that the blast tube 15 and nozzle 20 may be adjustable in a horizontal plane. For example, the nozzle 20 which carries the blast tube 15, may be mounted onto the boss 23 by means of a universal joint to permit adjustment of the blast tube in both the horizontal and vertical directions. The shape of the blast tube and the adjustment mechanism may of course have to be varied to permit appropriate adjustment both vertically and horizontally.

What is claimed:

1. A pressure jet burner comprising a blast tube mounted on and above and communicating with a generally horizontal duct which is in turn mounted on and above a housing containing air-supply means which supply air to the blast tube via said duct, the burner further comprising adjustment means whereby the directional position of the blast tube is adjustable both whilst the burner is operating and whilst it is not operating, the blast tube comprising a tubular body for conveying air within which is a nozzle for fluid fuel, said tubular body being fixed to said nozzle, the nozzle having an actuating rod which is operatively associated with an operating arm such that movement of the operating arm adjusts the position of the blast tube.

2. A burner as claimed in claim 1, wherein the operating arm extends through the horizontal duct in a direction parallel to the length of the duct, and carries a generally "U" shaped member having two spaced-apart legs between which the actuating rod projects such that movement of the operating arm in a direction parallel to the length of the duct causes the generally "U" shaped member to displace the actuating rod, which causes the blast tube to turn.

3. A pressure jet burner comprising a blast tube mounted on a housing and adjustment means whereby the directional position of the blast tube is adjustable both whilst the burner is operating and whilst it is not operating, the blast tube comprising a tubular body for conveying air within which is a nozzle for fluid fuel, the blast tube carrying a ceramic plate surrounding it and projecting outwardly from it.

4. A combined cooker/boiler comprising a combustion chamber, a water jacket which bounds the combustion chamber and from which hot water may be supplied, a hot gas outlet from the combustion chamber, from which hot gas may be supplied for use in cooking, a pressure jet burner within the combustion chamber and comprising a blast tube having an inlet and an outlet, a nozzle for fluid fuel within the blast tube and supported by it, means for supplying air to the inlet of the blast tube, means for supplying a fluid fuel to the nozzle, a bearing supporting the blast tube so that it can turn about an axis which is transverse with respect to the blast tube and actuating means for turning the blast tube from a first position, in which the blast tube is wholly within the combustion chamber and the nozzle is directed towards the water jacket, to a second position, in which the blast tube is wholly within the combustion chamber and the nozzle is directed towards the hot gas outlet of the combustion chamber.

* * * * *